US005926267A

United States Patent [19]

Färber

[11] Patent Number: 5,926,267

[45] Date of Patent: Jul. 20, 1999

[54] PROCESS AND DEVICE FOR DETECTING EXTRANEOUS SUBSTANCES AND EXTRANEOUS FIBERS IN A FIBROUS COMPOSITE

[75] Inventor: Christoph Färber, Uster, Switzerland

[73] Assignee: Zellweger Luwa AG, Switzerland

[21] Appl. No.: 08/995,544

[22] Filed: Dec. 22, 1997

[30] Foreign Application Priority Data

Jun. 11, 1997 [CH] Switzerland ..... 1409/97

[51] Int. Cl.[6] ..... G01N 21/00

[52] U.S. Cl. ..... 356/238; 356/237; 356/429

[58] Field of Search ..... 356/429–430, 356/237–238, 394; 250/559.12, 559.13, 559.2, 559.39, 559.4, 559, 45–49; 73/159–160; 242/36; 57/264–265; 28/227

[56] References Cited

U.S. PATENT DOCUMENTS 3,746,865 7/1973 Burch ..... 356/431
4,739,176 4/1988 Allen et al. ..... 356/430
5,054,317 10/1991 Laubscher ..... 73/160

FOREIGN PATENT DOCUMENTS 0679599 11/1995 European Pat. Off. .
0744478 11/1996 European Pat. Off. .
1211463 11/1997 United Kingdom .
WO93/13407 7/1993 WIPO .

*Primary Examiner*—Robert Kim
*Attorney, Agent, or Firm*—Burns, Doane, Swecker & Mathis

[57] ABSTRACT

The invention relates to a process and a device for detecting extraneous substances and extraneous fibers in a fibrous composite. In order to detect extraneous substances and extraneous fibers, on the one hand when they may make their presence felt in a disruptive manner because of their concentrated nature, and on the other hand, when they are not already processed in a finished product, the fibrous composite (2) is to be shaped to form a band (4) and the extraneous substances and extraneous fibers are to be detected in the band.

8 Claims, 3 Drawing Sheets

PROCESS AND DEVICE FOR DETECTING EXTRANEOUS SUBSTANCES AND EXTRANEOUS FIBERS IN A FIBROUS COMPOSITE

BACKGROUND OF THE INVENTION

1. Field of the Invention

The invention relates to a process and a device for detecting extraneous substances and extraneous fibers in a fibrous composite.

2. Description of the Related Art

From EP 0 744 478, for example, a device for extraneous fiber detection on an opening machine is known, with the aid of which fibers in a fiber-opening line are examined for deviations in color by means of colour sensors. This takes place in the region of an opening roller, where the fibers rest on or against the opening roller in a very loose composite.

From WO 93/13407 a process for identifying extraneous fibers in a moving yarn is known, in which light is thrown onto a stationary point on the yarn and a number of sensors pick up the reflected light and the transmitted light.

From EP 0 679 599 a fiber band monitoring arrangement is known, which has the function of detecting a break in the fiber band and in which the transport movement of the band is detected by a sensor.

From GB 1 211 463 a test apparatus is known, with the aid of which it is possible to identify, in the laboratory, extraneous fibers in a band made of fibers. In this apparatus, the band is pressed flat and fanned out so that it subsequently forms only a comparatively thin layer, which can be transilluminated.

The known processes and devices each have specific disadvantages, depending upon their construction and the place in the production line at which they act. If the identification or detect-on of the extraneous fibers and extraneous substances takes place in the yarn, the only possibilities available are either to cut out portions of yarn contaminated by extraneous fibers or extraneous substances, something which interrupts production of the yarn and results in splices in the yarn when the latter is put together, or else to leave the contaminants in the yarn. Considerable lengths of yarn may be affected, depending upon the nature of the contamination. If the identification or detection takes place too early in production, for example in the opening machine, it is often possible to remove contaminants only by also centrifuging out fairly large quantities of the non-contaminated fibrous composite with them. In this connection, however, it is also possible for the contamination to occur in such an attenuated manner that it may possibly not be identified by sensors at all, because set threshold values are not reached by the sensor signals. If it is desired to identify contaminants still earlier, for example when the fibrous material occurs in flocks, contaminants may possibly not be identified at all because they are concealed inside the flock. If contaminants and extraneous fibers are ascertained in known manner in the band, the latter must be centrifuged out of the current production and is altered to such an extent, for measurement or examination purposes, that it can be said to be destroyed.

BRIEF SUMMARY OF THE INVENTION

The invention, as characterised in the claims, therefore achieves the object of detecting extraneous substances and extraneous fibers in a fibrous composite during current production, on the one hand when they may make their presence felt in a disruptive manner because of their concentrated nature, and on the other hand, when they are not already processed in a finished product.

This is achieved through the fact that the detection of extraneous fibers and extraneous substances in the fibrous composite takes place when the latter forms a fiber band during production. Depending upon the nature of the extraneous substances, detection may take place through capacitively or optically operating sensors, the signals from which are evaluated in an appropriate manner. That means, for example, that the signal from a capacitive sensor is not examined for deviations such as are brought about by fluctuations in the weight of the band, but for deviations such as are typical, for example, of extraneous fibers, extraneous substances, etc. In the case of optical sensors, the signals are evaluated in such a way that, for example, deviations in color or in surface constitution are filtered out or isolated and thus indicate an extraneous substance. In the case of optical sensors, the operation should preferably be carried out with incident light, and the reflection of the light should be measured. Different colors can be made visible in the sensor signals by filtering the light received. It is thus possible to differentiate between admissible color signals and inadmissible ones which indicate, for example, extraneous fibers. The place of detection of the extraneous fibres and extraneous substances preferably lies between the exit from a carder, section or the like and the entry into a can. For the detection of the extraneous fibers, the band is left in its shape, that is to say is not changed. If a contaminant is identified, there are various possible ways of reacting to it. A first possibility consists in stopping production or the processing device. Other possibilities consist in marking the carrier of the band or just that can which contained the contaminated band, or in marking the band itself in order to remove it later. The contaminants can also be cut out or removed in some other way, something which causes an interruption in the band. Alternatively, an alarm can be triggered.

The advantages achieved through the invention can be seen, in particular, in the fact that the fibrous composite, that is to say the cotton, for example, is not fanned out in a broad manner at the place of detection, a fact which reduces expenditure for detection purposes and does not destroy the test piece. This also means that the area to be subjected to detection, as a whole, by the sensors is small, a fact which limits the expenditure on sensors. Special deformation of the band is not necessary. If the contaminants occur in a heaped-up manner, it is almost certain that they will occur on the surface of the band and will thereby be reliably detected. Here, it is still possible to remove the contaminants without stopping the entire production process, since it is mostly only individual cans in a whole group that are affected. With the aid of the invention, concentrated vitiations or contaminations of large area are detected, which appear on the surface of the band.

BRIEF DESCRIPTION OF THE SEVERAL VIEWS OF THE DRAWING

The invention will be explained in greater detail below with the aid of an example and with reference to the accompanying drawings, in which.

DETAILED DESCRIPTION OF THE INVENTION

Figure 1:
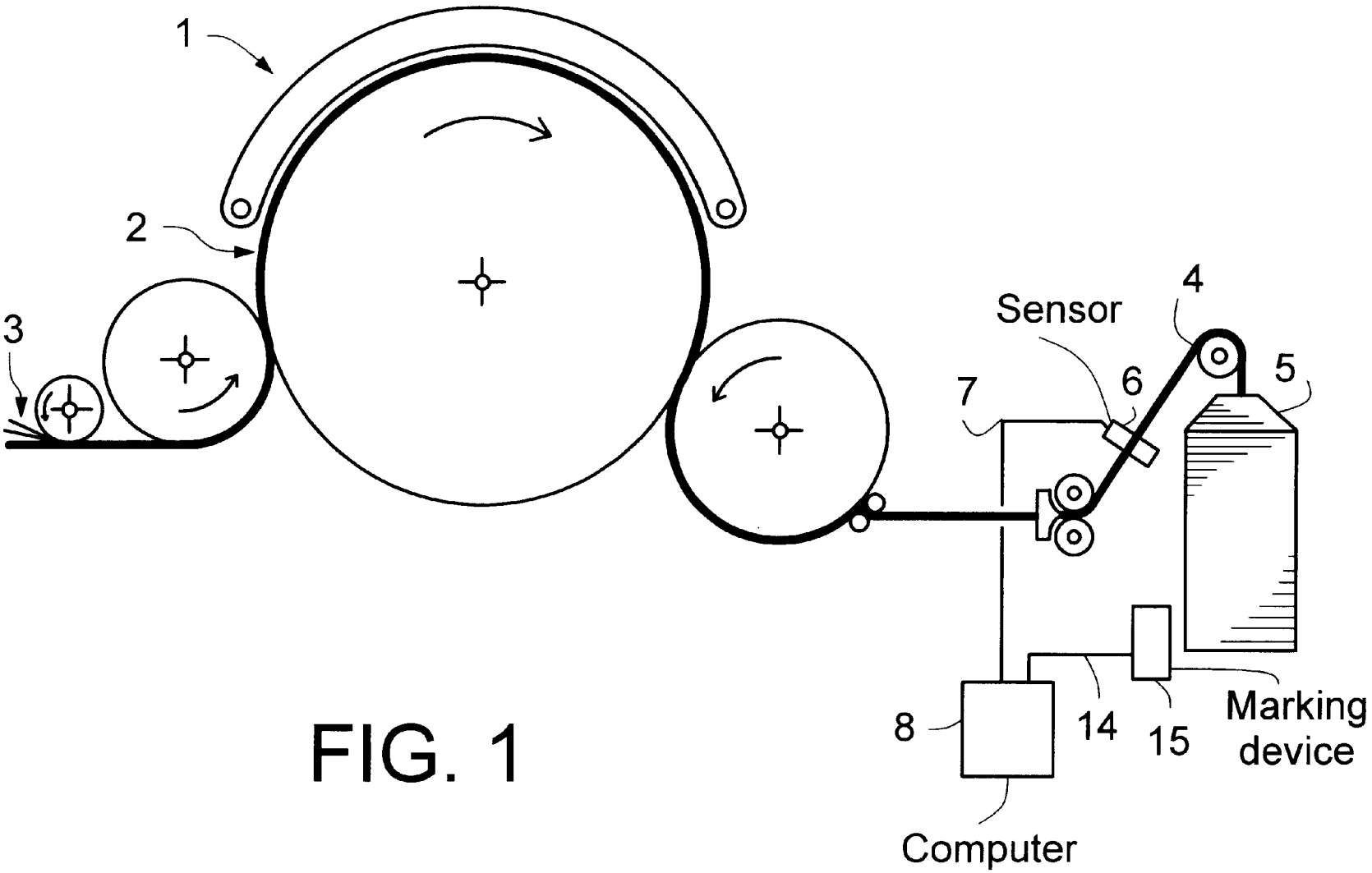
FIG. 1 shows part of a carder, represented diagrammatically.

FIG. 1 shows, represented in simplified form, a carder 1 which processes a fibrous composite 2, in a manner which is known per se and is therefore not represented in greater detail here, through the fact that a band 4 with an essentially wound or oval cross-section is produced from a laminar non-woven 3. The band 4 is deposited, in a manner which is likewise known, in a can 5 which has to be periodically replaced when it has been filled. Disposed along the band 4, between a delivery point of the carder 1 and the can 5, is a sensor 6 which is connected, via a line or a bus 7, to a computer 8. The latter is preferably further connected to a marking device 15 via an output 14. However, the said output 14 could likewise terminate in an alarm device.

Figure 2:
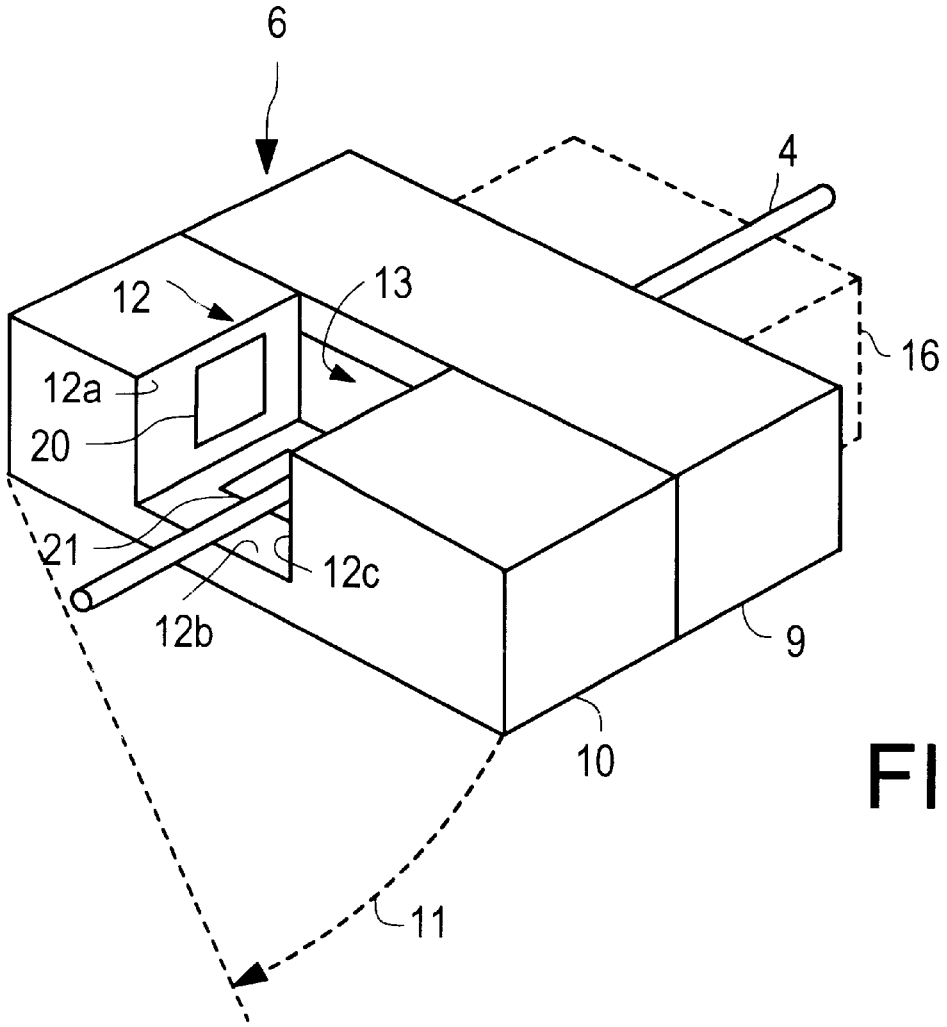
FIG. 2 shows a sensor for band material.

FIG. 2 shows a possible design for a sensor 6 for the band 4. The said sensor may consist of two parts 9 and 10 which are of identical composition and are mounted so as to be tiltable in relation to one another, as is indicated by an arrow 11. The two parts 9 and 10 each have a measuring chamber 12, 13 which is open towards one side, the two measuring chambers being disposed in such a way in relation to one another that the band 4 is able to traverse the two parts 9 and 10 of the sensor by traversing the two measuring chambers 12, 13. The disposition of the measuring chambers 12, 13 is preferably selected in such a way that the band 4 is enclosed, if possible over its entire periphery, by the sensor 6. As can be seen, in particular, from the measuring chamber 12, the latter has three boundary faces 12*a*, 12*b* and 12*c*, and at least one, preferably two, of these boundary faces have a measuring system which terminates, for example, in a window 20, 21. Each part 9, 10 of the sensor has a measuring system such as is known, for example, from patent application WO 93/13407 or U.S. Pat. No. 5,054,317, the entire disclosure of which are incorporated by reference. Under these circumstances, parts of the measuring systems which are associated with oppositely located windows may also combine to form a measuring system, that is to say, for example, parts which are associated with the window 20 and with a non-visible window in the boundary face 12*c*. For the purpose of inserting the band 4, it is possible for at least one part 9, 10 to be pivoted await manually or automatically, so that the band 4 can be fed, for example laterally, into the measuring chambers 12, 13.

Figure 3:
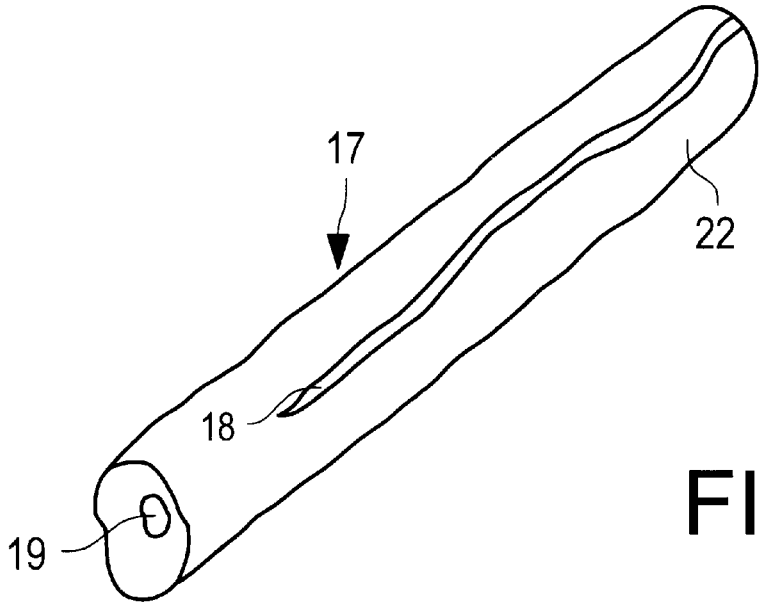
FIG. 3 shows a band with a typical contaminant.

FIG. 3 shows a portion 17 of a band, on the surface 22 of which it is possible to identify a contaminant 18 which is to be detected by the invention. The said contaminant consists, for example, of a small composite of different-colored fibres which have been produced, for example, by soiling in a preceding processing stage or in the carder itself. It can also be seen, from the point 19, that the contaminant 18 has moved away from the surface 22 at certain points.

Figure 4:
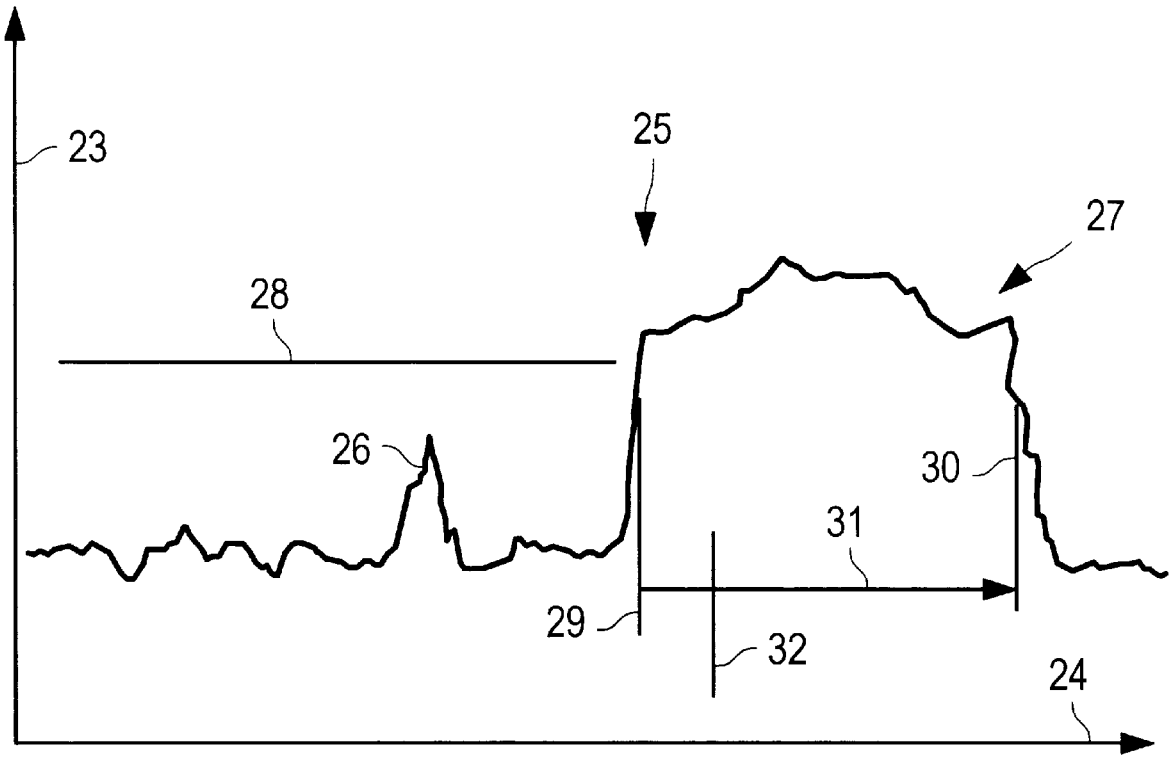
FIG. 4 shows a typical signal pattern.

A signal pattern 25, such as can be detected by the sensor 6 or one of the two parts 9, 10 of the sensor, is shown in FIG. 4 above a time axis 24 and beside an axis 23 along which amplitude values are plotted. 26 designates the signal from an extraneous substance or an isolated contaminant. The signal from a vitiation or contaminant, such as is designated by 18 in FIG. 3 for example, can be seen at 27. A threshold value 28 is now applied in such a way that it is not reached by signals from isolated contaminants. If, however, this threshold value 28 is exceeded for a period of time, such as is the case with the signal 27, its time duration, which is represented by the arrow 31, is detected. A threshold value 32 can be predetermined for this time duration too.

Figure 5:
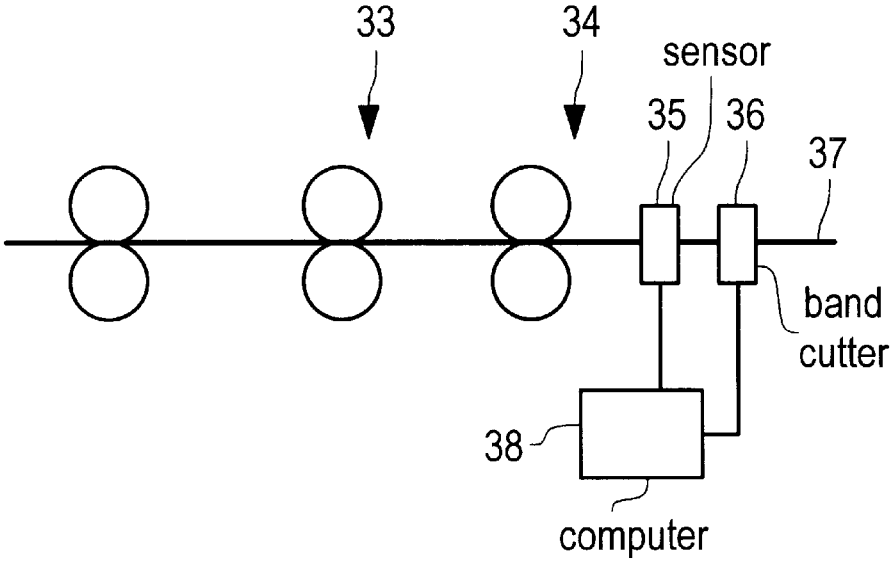
FIG. 5 shows part of a section, represented diagrammatically.

FIG. 5 shows a section 33 which is known per se and at the exit 34 from which there are disposed a sensor 35 and a band-cutter 36 for a band 37. The sensor 35, the composition of which is like a sensor according to FIG. 2, and the band-cutter 36 are both connected to a computer 38.

The way in which the invention works is as follows:

Before full operation of the carder scares, feeder band is fed out of the carder and into the sensor 6, in which the part 10, for example, is pivoted away as indicated by the arrow 11. When the band 4 is fed in, the part 10 can be pivoted back again and full operation of the carder can be started. The sensor 6 then detects, for example optically, deviations in color or intensity or capacitive deviations in the dielectric and converts these into an electrical signal 25, which is analysed in the computer 8. Stored in the said computer 8 are algorithms and threshold or comparison values 28, 32 which make it possible to identify extraneous fibers or extraneous substances from the signal in the line 7. If these are identified, a signal which triggers an alarm or the stopping of the installation is issued via the output 14.

Alternatively, however, the output 14 can also be connected to a marking device 15 which, activated by the said output, marks the relevant can 5 as the carrier of the band. A marking device 15 of this kind may, for example, be constructed as a paint-spraying arrangement which marks the external face of the can with paint. However, it is also conceivable, in automatic can-changing installations, to trigger a change of can prematurely by the signal in the output 14 in order to deposit contaminated points in special cans. However, a marking device 16 could also be fitted directly to the sensor 6 in order to identify the position of a contaminant on the band 4 itself in a conspicuous manner, so that the said band can be treated later by hand (FIG. 1).

Particularly when it has an optical measuring system, the sensor 6 detects changes in the color or structure of the surface of the band. In order to detect vitiations in the band, especially when they occur over a large area or in such a way as to be concentrated in so-called "swarms", the measuring system should have a resolution which tends to be small in respect of the location, that is to say so that individual extraneous fibers are not identified at all. The resolution is also selected in such a way that vitiations or extraneous fibers which are present in the interior of the band are not identified at all, even if they should show through to the surface. In the case of the optical measuring system, therefore, only light which is reflected on the band is measured. For this purpose, the surface is subjected to detection all round, on the entire periphery. In this way, detection can take place even at high band speeds of, for example, 300 m/min or 5 m/sec. The low resolution is achieved through the fact that measuring systems of low sensitivity are used, or that high threshold values for deviations from a normal signal are set in the computer 8, in order to indicate extraneous fibers. The resolution is also predetermined, in particular, by the threshold values 28, 32, there being started in the computer, when the threshold value 28 is exceeded, a counting operation for the period of time 31, to which operation the threshold value 32 in turn applies.

In the case of a section 33 (FIG. 5), or ultimately also in the case of other textile machines which process band, it is possible to provide the sensor 35 which emits signals to the computer 38. The latter activates, for example, a band-cutter 36 which cuts the band 37 when contaminants are detected, so that the vitiated part of the band can be removed.

I claim:

1. In a process for producing yarn from fibers which may contain extraneous material, the improvement comprising forming the material being processed into a linearly moving fibrous band at a stage in the production process before the formation of yarn, and sensing the surface of the linearly moving fibrous band at that stage in the process to determine whether the sensed portion of the fibrous band contains extraneous substances and extraneous fibers.

2. A process according to claim 1, wherein the process additionally includes, after detection of the extraneous substances and extraneous fibers, one operation out of the group of operations which comprises marking of the band, marking of the carrier of the band, removal of the band, interruption of the band, stopping of the processing device and triggering of an alarm.

3. In apparatus for producing yarn from fibers which may contain extraneous substances and extraneous fibers, the improvement which comprises a sensor for detecting extraneous material in a linearly moving fibrous band, said sensor at least partly enclosing said band and being responsive to extraneous substances and extraneous fibers exposed on more than one side of said band.

4. Apparatus according to claim 3, wherein said sensor is constructed so as to enclose the band on all sides.

5. Apparatus according to claim 3, wherein said sensor is connected to one element out of a group of elements comprising a marking device (15, 16), a bandcutter (36) and an alarm device.

6. Apparatus according to claim 3, wherein said sensor (35) is disposed at the exit (34) from a section (33).

7. Apparatus according to claim 3, wherein said sensor is disposed between the delivery point of a carder (1) and a can (5).

8. Apparatus according to claim 3, wherein said sensor includes at least one measuring system which works optically and analyses light rays reflected on the band.

* * * * *